United States Patent [19]

Byers

[11] Patent Number: 4,591,067

[45] Date of Patent: May 27, 1986

[54] PLASTIC INSERT FOR STORAGE VESSEL

[75] Inventor: Stuart D. Byers, Mississauga, Canada

[73] Assignee: Crophandling Systems Limited, Mississauga, Canada

[21] Appl. No.: 634,532

[22] Filed: Jul. 26, 1984

[51] Int. Cl.[4] ..... B65D 6/32

[52] U.S. Cl. ..... 220/81 R; 220/75; 220/5 A

[58] Field of Search ..... 220/81 R, 83, 80, 71, 220/5 A, 1 B, 408, 461, 470, 75, DIG. 3

[56] References Cited

U.S. PATENT DOCUMENTS

| | | | |
|---|---|---|---|
| 1,844,961 | 2/1932 | Kramer | 220/1 B X |
| 2,729,313 | 1/1956 | Ernestus | 220/75 X |
| 2,914,149 | 11/1959 | Walker | 220/81 R X |
| 2,953,276 | 9/1960 | Dunn | 220/81 R X |
| 3,167,208 | 1/1965 | Proctor | 220/81 R X |
| 4,240,562 | 12/1980 | Holschlag | 220/5 A X |

*Primary Examiner*—Steven M. Pollard
*Attorney, Agent, or Firm*—Donald E. Hewson

[57] ABSTRACT

Bolted plate water towers have a potential for leakage at abutment joints between the plates, if the gap between the abutting edges is large, and if the water pressure is high enough to extrude the jointing compound out of the gap. But the gap must be wide enough to ensure the edges do not touch. In the invention, a compressible plastic insert (8) is placed between the abutting edges (5,6) to keep the gap from being so variable. Hence, water towers can be built to greater height.

9 Claims, 4 Drawing Figures

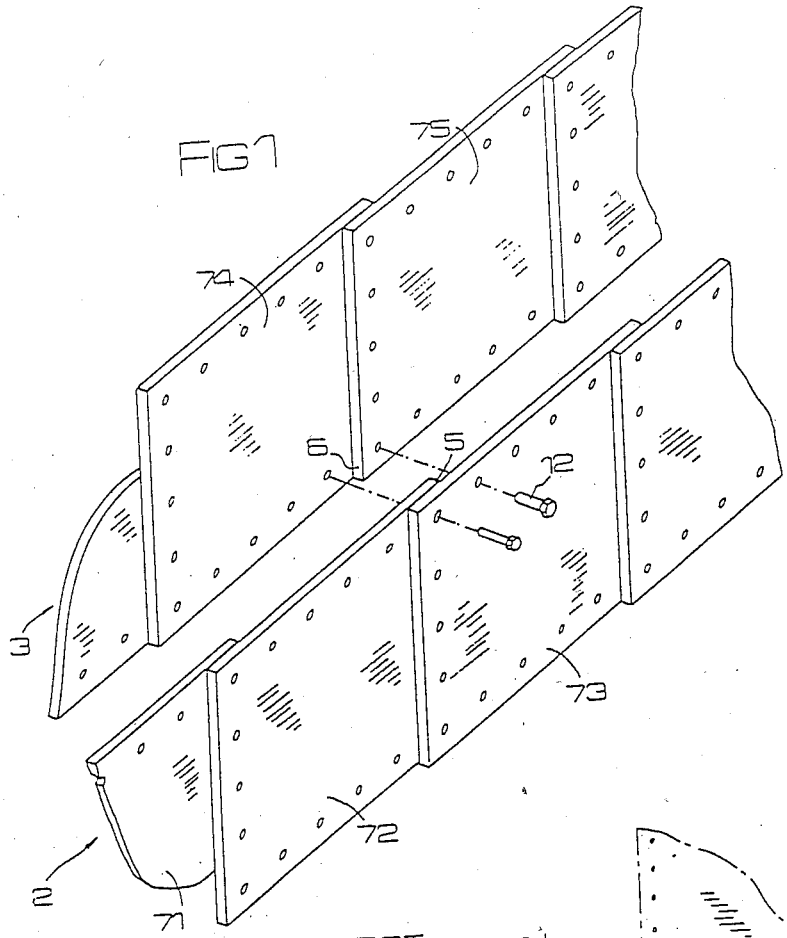
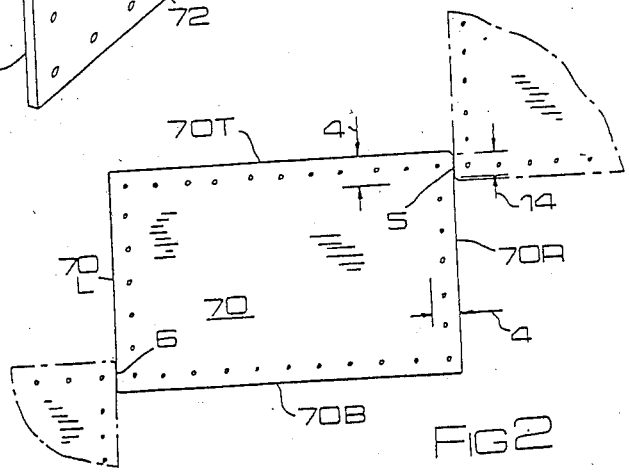
FIG2

PLASTIC INSERT FOR STORAGE VESSEL

This invention relates to storage vessels fabricated from flange-less plates fastened together with headed fasteners. An example of such a vessel is a bolted-plate water storage tower.

BACKGROUND TO THE INVENTION

Bolted-plate towers are preferred to welded towers because the plates can be given a protective coating in the factory, i.e., before the tower is erected. The plates can be coated with a thin layer of glass, for example.

A problem with bolted-plate towers is in the precautions that must be taken to prevent leaks. Jointing compound is daubed over all the surfaces that are to be squeezed together by the bolts; and if the bolts are tightened carefully then the bolted joints are secure enough. But the edge-abutment joints, where they occur between the flange-less plates, cannot be pressed together by tightening the bolts.

The tower is designed and built so that the abutting edges of plates are as close together as possible. However, the abutting edges cannot be allowed to actually come in contact with each other, because such contact might damage the delicate coating.

U.S. Pat. No. 2,729,313 (ERNESTUS, Jan. 3, 1956) shows an example of a bolted-plate tower made of glassed, flangeless plates, and shows the presence of such edge-abutment joints.

Typically, it is possible to arrange that the abutting edges can never be closer together than about 1 mm, but yet never more than about 4 mm apart (i.e., there is a tolerance on the gap of 3 mm). If the plates were to be made with a tighter tolerance on the gap than that, then they could not be manufactured economically on normal press machinery.

Thus the designer of the tower is faced with the fact that some of the abutment gaps might be as large as 4 mm. The designer must therefore limit the height of the tower so that the water pressure at the very bottom is not enough to cause the jointing compound to be extruded through a gap that is 4 mm wide.

However, if the tolerance on the gap between abutting plates could be reduced from 3 mm down to say 1 mm (so that the gap varied from 1 mm to only 2 mm) then water towers could be built to a greater height.

The invention provides a means whereby the abutment gap can be economically controlled within tight limits, to permit higher towers to be built.

BRIEF DESCRIPTION OF THE INVENTION

In the invention, a compressible plastic insert is placed between the abutment edges. The benefit that comes from the insert may be explained by this example. Let the gap between the edges be set to a minimum width of 9 mm. Now, the economics of making the plates dictate that the plate-to-plate gap must be allowed to vary 3 mm. So the maximum gap that must be catered for will be 12 mm, if the minimum is 9 mm. Let the plastic insert be 10 mm thick. Now, if the plate-to-plate gap is the maximum 12 mm, then the abutment gap through which the water can leak is only 2 mm, which is small enough to be reliable against the high pressures that exist at the bottom of very tall tanks. On the other hand, if the plate-to-plate gap is the minimum 9 mm, then the 10 mm insert is compressed down to 9 mm: the material is such that is can be compressed without damaging the delicate coating on the edges of the plates.

The invention will now be further described by way of example.

DETAILED DESCRIPTION OF PREFERRED EMBODIMENTS

FIG. 1 shows the plates of a water tower;

FIG. 2 shows the plates in elevation;

FIG. 1 shows parts of a bolted-plate water storage tower. The tower is cylindrical, so that the plates from which it is made are curved to some extent (rather than their being quite flat, as is shown, for convenience of illustration, in the Figure).

Figure 3:
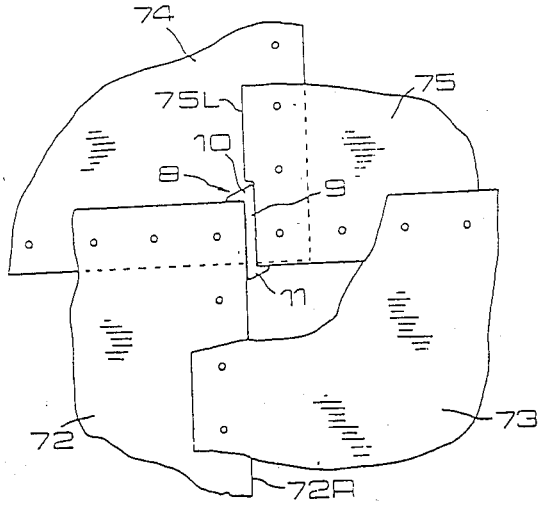
FIG. 3 shows a close-up of the plates.

FIG. 1 shows two rows 2,3 of plates 70. (Reference numeral 70 refers to the plates generally; numerals 71,72 . . . refer to particular plates). The plates are all identical, and all as shown in FIG. 2.

Each plate 70 has lines of bolt holes along all four edges 70L, 70R, 70T, 70B. A margin 4 is defined, contiguous with each edge, as being the area of the plate that is overlapped by neighbouring plates.

Each plate (e.g. 72) overlaps its neighbour (e.g. 73) in the same row (e.g. 2) as shown in FIG. 1, and each plate (e.g. 72) overlaps its direct neighbour (e.g. 74) in the rows (e.g. 3) above and below. But the rows 2,3 are staggered a distance equal to the width of one side margin 4, so that a top portion 5 of the right hand edge 72R of a plate 72 abuts against the bottom portion 6 of the left hand edge 75L of the plate 75 that is located diagonally in the next row 3 above. It is this abutment that is to receive the plastic insert of the invention.

FIG. 3 is a close-up of the abutment area, showing the plates 72, 73, 74, 75. A plastic insert 8 comprises a main column 9 together with protruding ears 10, 11. The insert 8 is almost completely hidden when the tower is assembled. It is trapped between the edges 72R and 75L and also between the front surface of the plate 74 and the back surface of the plate 73. Only the topmost ear 10 is visible, to act as a marker to prove the presence of the insert.

To assemble the tower, first a row of plates is formed into a complete ring around the foundation of the tower. Jointing compound is daubed on the side margins that will be clamped together by bolts 12 placed in the holes. Only the side margins are bolted together: the horizontal rows of holes are left clear for the moment.

When the row of plates has been made into a complete ring, the ring is jacked up so that it is now spaced from the floor. The next row of plates is assembled resting on the ground, the jacked up height of the first ring being such that the top margin of the next ring just overlaps the bottom margin of the first ring. The top and bottom margins are daubed with compound where they are to be brought into contact, and the bolts in the horizontal lines of holes are inserted. The plastic inserts 8 are pressed into the jointing compound, between the abutting edges just before the overlapping plates are assembled.

When the next ring has been completed, and all the inserts 8 inserted, and all the bolts between the two rings have been tightened, the two rings can be jacked up together, to allow a further ring to be assembled from below. This process continues until the whole tower is finished.

The lines of bolts can be arranged to fan-out slightly so that the tower is of constant diameter all the way up, even though the plates are overlapped. Alternatively, the plates need not be identical but can be dimensioned to provide say a reducing diameter towards the top of the tower.

The plastic insert 8 of the invention is, as described earlier, of such dimension that if the abutment gap is at the narrow end of its permitted tolerance the insert is compressed, whereas if the gap is at the widest end of its permitted tolerance a space, though present, is small enough to be not prone to leakage.

The insert is the same both ends, so that the workmen have no need to make sure the insert is the right way up.

As shown in FIG. 3, the bottom portion 6 of edge 75L of the plate 75 has been cut back. This operation is done as a fine-blanking or similar operation, in which the line of the cut is set by holding the plate 75 with its right hand edge 75R firmly against a location stop on the blanking press. Thus the cut can be more accurately dimensioned with respect to the right hand edge 75R than is the edge 75L. Thus the whole left hand edge 75L of the plate need not be cut accurately, only the cornermost portion 6 of that edge.

Alternatively, the top portion 5 of the right hand edge could be the one that was cut, this time accurately from a location stop on the left hand edge.

Alternatively again, both portions could be cut.

Figure 4:
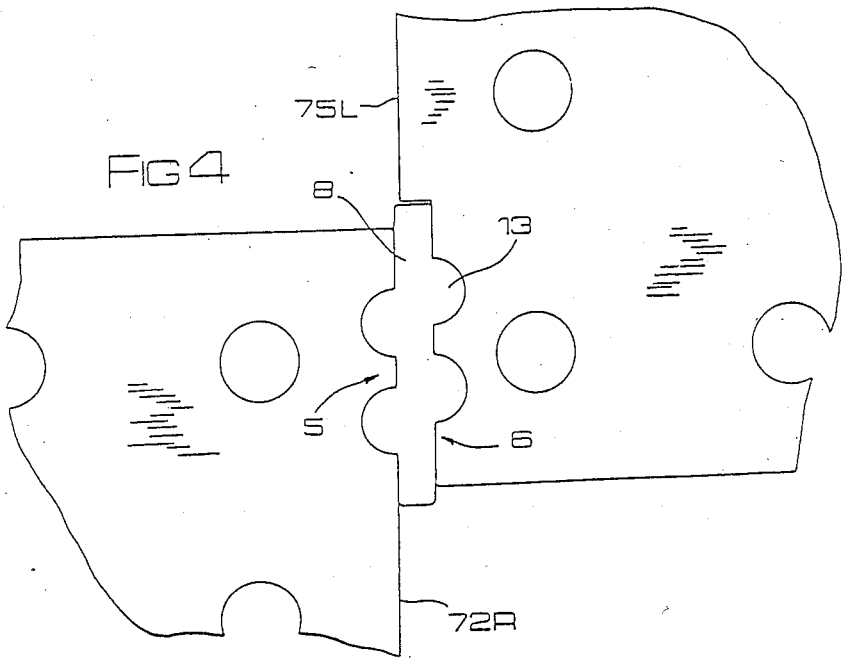
FIG. 4 shows a close-up, corresponding to FIG. 3, of a modification.

The cuts need not be straight as shown in FIG. 3 but could be shaped, as shown for example in FIG. 4. Here, if there is any "settling apart" of the plates, due to the stresses induced when the tower is filled with water, for example, then the insert can move slightly to keep the gap closed. The jointing compound used of course has to be flexible enough to permit this, and most compounds have only a very limited flexibility, once they have cured.

The protrusions 13 on the insert act to key the insert to the plates, to guard against its being extruded through the gap by the water pressure.

For very high towers the plates may be overlapped for more than half their vertical height. The length of the abutment in that case would be very long, to cope with the fact that the water pressure would be correspondingly greater. More than one insert might then be used, disposed along the length 14 of the abutment.

I claim:

1. Cylindrical storage vessel fabricated from flangeless plates fastened together with headed fasteners that pass through holes in the plates; wherein:

said plates are rectangular and arranged in rows to form the circumference of the vessel;

holes for the headed fasteners are disposed in margins contiguous with the top, bottom and side edges of a plate;

each plate has surface-to-surface contact with the plate next to it in the same row over the full height of the their side margins and over no more than the width of their side margins;

each plate has surface-to-surface contact with a plate in the row immediately above, over a height at least equal to the height of a top margin;

the plates in one row are staggered with respect to the plates in the next row above to the extent that a top portion of one side edge of a plate in the said row is in abutment with a bottom portion of the opposite side edge of a plate in the row above;

and where an insert of resiliently compressible material is placed between edges that are in abutment;

where said insert occupies a substantial portion of the length of the abutment between said edges;

said insert is placed between the said top and bottom portions of the respective side edges; and where at least one of said top and bottom portions of each of said plates is cut inwards from the general level of the side edge of said plate.

2. Vessel of claim 1 where only one of the top and bottom portions of the respective side edges are cut inwards from the general level of the respective side edges of the plates.

3. Vessel of claim 2, where the plastic insert is so shaped as to be mechanically retained between the abutting edges against pressure in the vessel tending to eject the insert from between the edges, and where the insert is so shaped (13) as to fit the cut shape of the portions, and where the portions are so cut to shape that pressure in the vessel acting on the insert tends to force the insert more into contact with both the portions.

4. Vessel of claim 1, where the plastic insert is so shaped as to be mechanically retained between the abutting edges, against pressure in the vessel tending to eject the insert from between the edges.

5. Vessel of claim 1, where the plastic insert is so shaped that a marker portion (10) of the insert protrudes from the abutment, to serve as an indicator that the insert is present.

6. Vessel of claim 1, wherein the insert is nominally thicker, in the radial direction, than the thickness of the plates.

7. Vessel of claim 1, wherein the insert is resiliently compressible by at least 1 mm, measured in the direction of the circumference of the vessel.

8. Vessel of claim 1, wherein the nominal gap between the abutting edges is 10 mm, and the tolerance on the gap is one-and-a-half mm, and wherein the insert has a width, measured in the same direction as the width of the gap, of 9 mm.

9. Vessel of claim 1, wherein the insert is of plastic.

* * * * *